US005571322A

United States Patent [19]

Yao et al.

[11] Patent Number: 5,571,322

[45] Date of Patent: Nov. 5, 1996

[54] PENCIL MARKING DEVICE FOR CLIPPED CLOTH

[75] Inventors: Shin-Chuan Yao, Tu Cheng; Yun-Kuang Lin, Yung Ho; Hsiang-Hung Peng, Hua Lien Hsien, all of Taiwan

[73] Assignee: China Textile Institute, Taipei Hsien, Taiwan

[21] Appl. No.: 489,745

[22] Filed: Jun. 13, 1995

[51] Int. Cl.[6] ..... B43L 13/00

[52] U.S. Cl. ..... 118/76; 118/256; 118/669; 118/681; 33/18.1; 33/26; 33/1 M

[58] Field of Search ..... 118/76, 256, 669, 118/681; 33/18.1, 26, 27.01, 1 M

[56] References Cited

U.S. PATENT DOCUMENTS

| | | | |
|---|---|---|---|
| 2,807,236 | 9/1957 | Wolf | 118/76 |
| 4,015,269 | 3/1977 | Edo | 346/139 C |
| 4,157,552 | 6/1979 | Nakajima | 346/141 |
| 4,324,047 | 4/1982 | Roch | 33/18 R |
| 4,423,428 | 12/1983 | Kuwabara et al. | 346/139 C |
| 4,426,783 | 1/1984 | Gerber et al. | 33/1 M |
| 5,042,155 | 8/1991 | Yoshioka et al. | 33/18.1 |
| 5,099,784 | 3/1992 | Gross | 118/243 |
| 5,150,525 | 9/1992 | Iai | 33/18.1 |
| 5,164,009 | 11/1992 | Chandler | 118/13 |
| 5,394,174 | 2/1995 | Nguyen | 346/139 R |

*Primary Examiner*—Long V. Le

*Attorney, Agent, or Firm*—Morton J. Rosenberg; David I. Klein

[57] ABSTRACT

A pencil marking device for clipped cloth includes a fixing base, a pencil pedestal, a driving pedestal, a driving source, and at least two sensors, in which the fixing base is fixed on the automatic marking machinery, and the pencil pedestal is connected in it. The tooth ring is formed on the outside of the pencil pedestal. The driving pedestal is installed on one side of the fixing pedestal and is engaged with the tooth ring of the pencil pedestal through an active gear rack for driving the pencil pedestal to rotate at a fix point. The active gear rack is connected with the driving source by an U shape connection and driven to move horizontally by the driving source. The sensors are installed on the ends of the driving pedestal respectively for sensing the moving range of the active gear rack. The range of the horizontal movement of the active gear rack is restricted for driving the pencil in the pencil pedestal to rotate and mark at a fix position, then an automatic pencil marking device is constructed.

3 Claims, 5 Drawing Sheets

PENCIL MARKING DEVICE FOR CLIPPED CLOTH

BACKGROUND OF THE INVENTION

1. Field of the Invention

The present invention relates to a new pencil marking device for clipped cloth, it especially relates to the pencil pedestal used in the automatic marking device and the rotary pencil marking device which has high precision positioning function and can mark the clipped cloth with a device which can automatically rotate the pencil to mark at a fix point.

2. Description of the Prior Art

The clothes is one of the indispensable daily necessities, the quality thereof is increased because of the promotion in the skill of spinning and manufacturing in recent years, so the producing skills and the mechanic structures concerned attract the attention of the industrial field.

The general known clothes manufacturer must draw the needed marks on the half-finished clipped cloth during producing, such as the position of button and the folding line of the waist for the tailor to proceed the next process.

The conventional method uses a skillful people to mark the cloths by fixing the dies plate on the clipped cloth, in other words, it marks the clipped cloth by the marking pencil held on the operator's hand as shown in FIG. 5. For example, the aligning marks for sewing are marked as the reference to the reprocessing operator.

Therefore, the aforesaid method completely uses the labor to hold and rotate the pencil for marking the clipped cloth, and the marks are different according to the diversified clothes, so there is heavy load to the operator's hand for the long time repeatedly holding and rotating the pencil to mark the clipped cloth, then, the quality and the precision are seriously influenced by the errors in marking. On the other hand, the marking speed is getting slow when the operator has muscular pains on his hand, it imperceptibly decreases the reprocessing efficiency to the clipped cloth, which is the major troublesome of the manufacturer in marking the cloths.

SUMMARY OF THE INVENTION

From the foregoing description, the main object of the invention is to provide a pencil marking device for the clipped cloth, wherein the fixing base is constructed in the structure of the automatic marking device, the pencil pedestal is constructed on the fixing base, and the tooth ring is formed on the circumference of the pedestal. Another pedestal for driving components is installed on one side of the fixing base, it is engaged with the tooth ring of the pencil pedestal by an active gear rack, and then the pencil pedestal is driven to rotate by the horizontal displacement thereof.

The other end of the active gear rack is connected with a driving source by an U shape connection, and it is moved by the horizontally driving of the driving source. A pair of sensors are installed on the ends of the pedestal of driving components separately for sensing the moving range of the active gear rack, the active gear rack is controlled by the sensors to horizontally move in a certain range, and then, the high precision marking is achieved by the pencil in the pencil pedestal which is repeatedly rotated, meanwhile, the marking errors produced by manually marking avoided, and the efficiency and the quality are increased effectively for improving the disadvantage and troublesome of the conventional manually marking method.

BRIEF DESCRIPTION OF THE DRAWINGS

The other objects and the detail structure will be best understood when read in conjunction with the following description and drawings, wherein.

DESCRIPTION OF THE FIGURES

Figure 1:
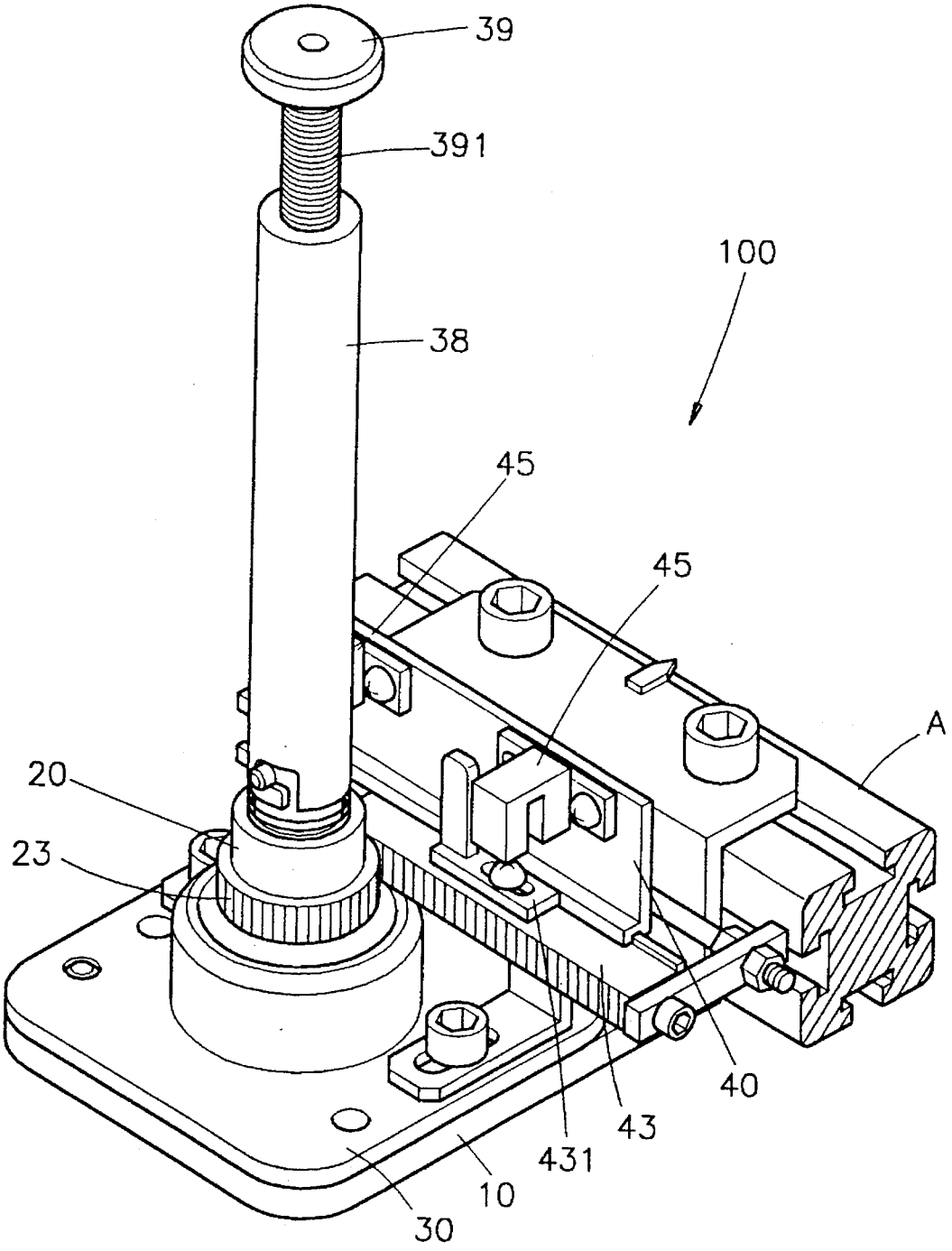
FIG. 1 is the perspective view of the invention.

100. pencil marking device
10. fixing base
11. locating pin
12. tap hole
13. marking hole
20. pencil pedestal
21. sleeve barrel
22. tenon
23. tooth ring
24. circular groove
30. pencil base
31. locating hole
32. receiving groove
33. needle bearing
34. retainer ring
30A. bolt
35. top column
351. receiving end
36. first elastic brake element
37. second elastic brake element
38. pencil sleeve
381. screw region
382. L slot
39. pencil locking component
391. screw part
40. driving pedestal
41. locking part
42. sliding rail
43. active gear rack
431. approaching lamella
44. long hole
45. sensor
40A. bolt
50. driving source
51. linking stick
52. linking element
53. linking element
50A. bolt
50B. nut
A. connecting link
B. pencil

DETAILED DESCRIPTION OF THE INVENTION

Figure 2:
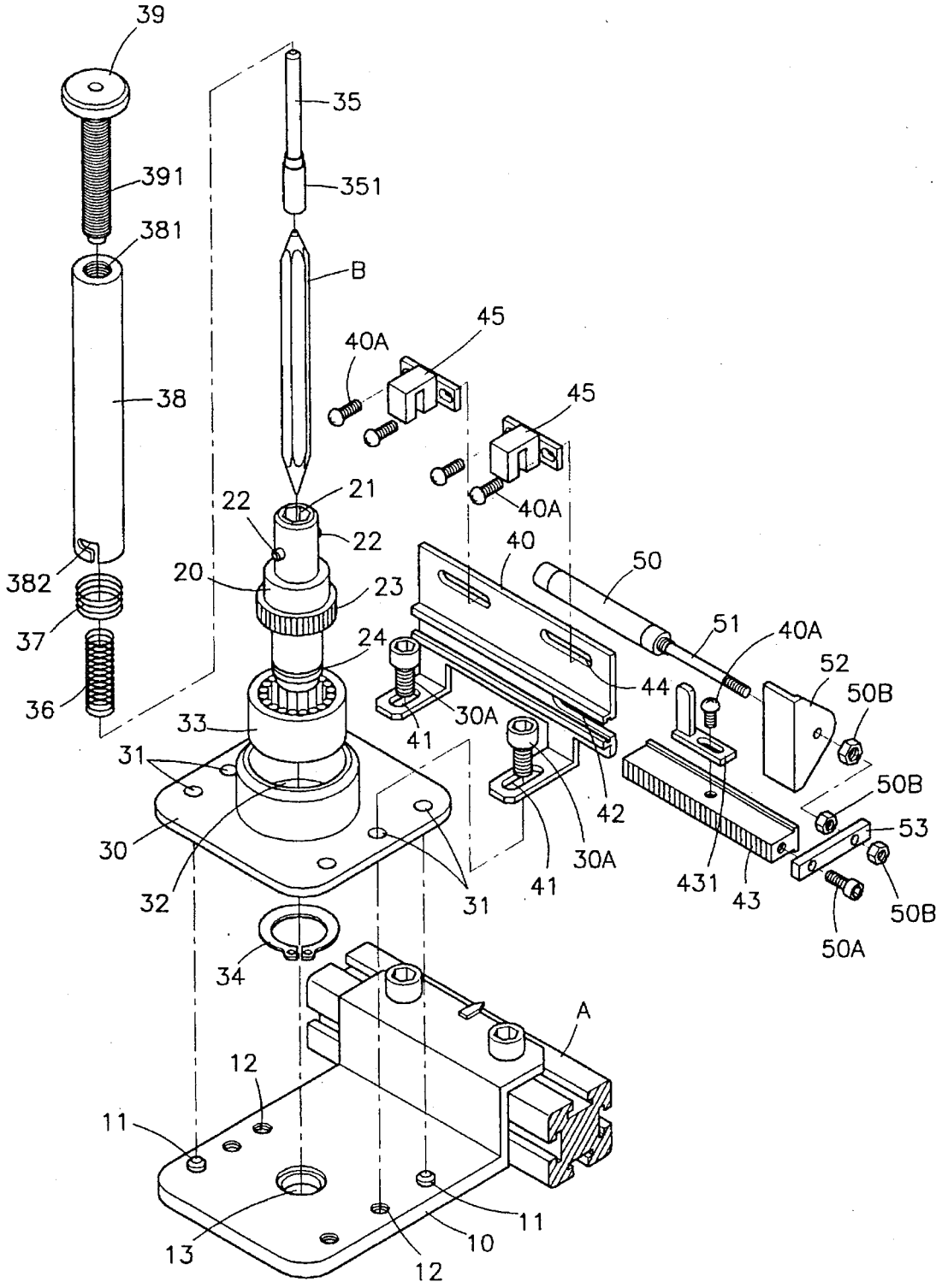
FIG. 2 is the perspective view showing the construction of the invention.
Figure 3:
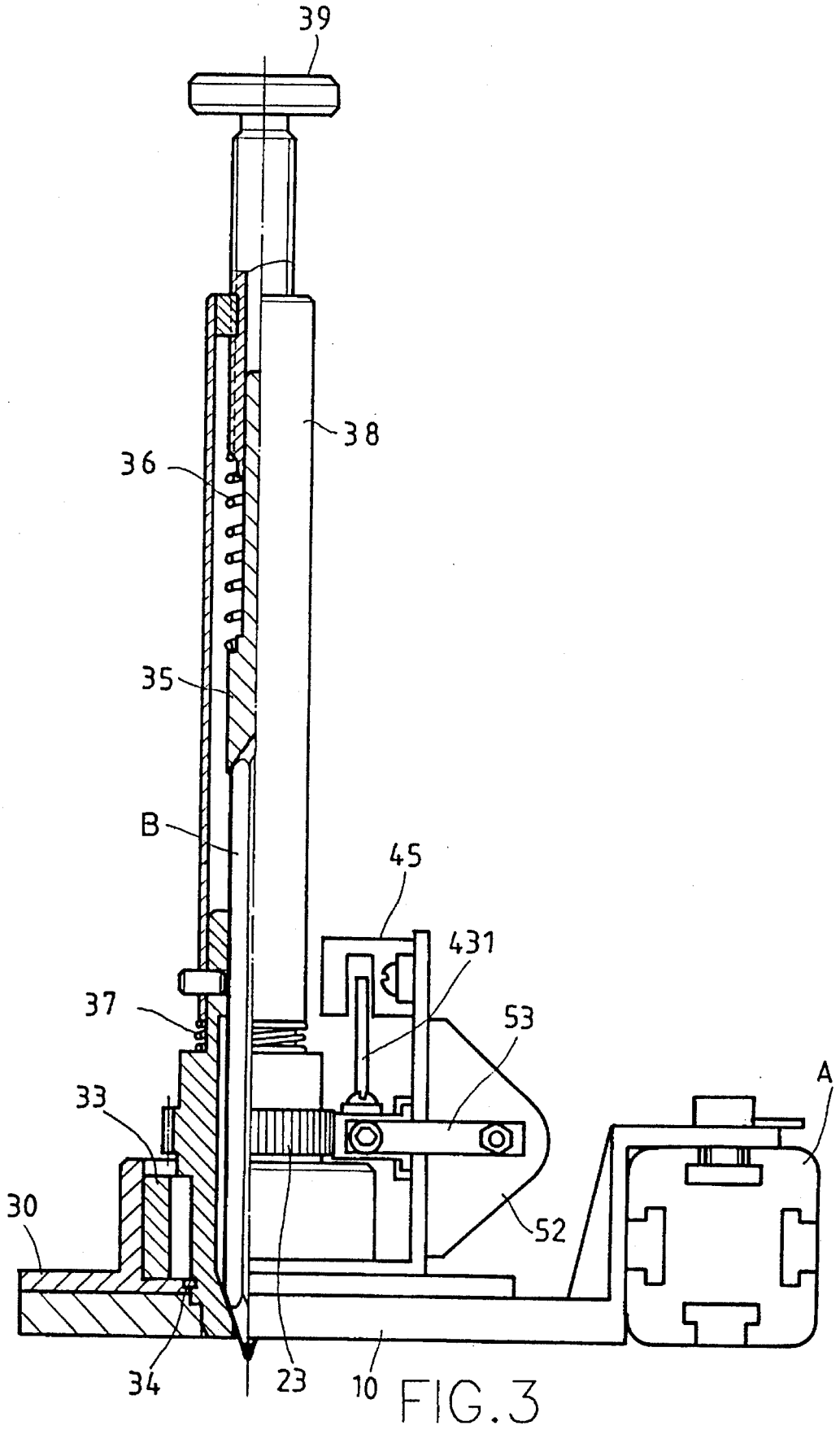
FIG. 3 is a local sectional view showing the structures of the pencil pedestal and the fixing base of the invention.

As shown in FIGS. 1, 2, and 3, the pencil marking device 100 in this invention includes a fixing base 10, wherein the end of the fixing base 10 is bent to be an inverse L shape fur being connected with a connecting link A of an automatic marking machinery (another patent application, detail description is not given because it is out of the inventing rang of this invention) which can move upwards and downwards, so that it is driven to move upwards and downwards by the automatic marking machinery. A plurality of locating pins 11 and tap holes 12 are installed and formed on the other end of the fixing base 10 respectively, and a marking hole 13 are formed on the central portion of the fixing base 10.

Besides, a pencil pedestal 20 includes a sleeve barrel 21 for receiving and cramping the pencil B with proper length, the tenons 22 are installed on the two sides of the upper section of it respectively, then a tooth ring 23 is circularly formed on the central section of it, therefore a circular groove 24 is formed on the lower section of it.

The pencil base 30 is constructed according to the dimension of the fixing base 10, a plurality of locating holes 31 used to match with the locating pin 11 and tap hole are formed on the circumference of the fixing base for screwing the pencil base 30 on the fixing base 10 by the bolt 30A. A receiving groove 32 with respect to the marking hole 13 and matching with the pencil pedestal 20 is formed on the center of the pencil base 30 for stably fixing the pencil pedestal 20 after the needle bearing 33 is engaged with the lower section of the pencil pedestal 20 and buckled on the circular groove 24 of the pencil pedestal 20 by a retainer ring 34.

A receiving end 351 is defined on the bottom of the top column 35 for connecting with the top end of the pencil B, the first elastic brake element 36 and the second elastic brake element 37 are engaged with the top column 35, and a screw region 381 and a L slot 382 matching with the tenon 22 of the pencil pedestal 20 are respectively formed on the ends of the pencil sleeve 38 the length and the inner diameter of which are matching with the pencil B and the top column 35 for stably engaging the pencil sleeve 38 with the upper section of the pencil pedestal 20 by the stable engagement between the L slot 382 and the tenon 22 of the pencil pedestal 20 behind the pencil sleeve 38. The first elastic brake element 36 and the second elastic brake element 37 are engaged with the top column 35 and the pencil pedestal 20. The screw part 391 is formed on the lower portion of the other pencil locking component 39 for being screwed in the screw region 381 of the pencil sleeve 38. So the top or the pencil B is stably fixed by tightly touching the end of the screw part 391 with the top column 35.

The locking part 41 used to match with the tap hole 12 of the fixing base 10 is formed on the two sides of the bottom of the driving pedestal 40 for being screwed on the fixing base 10 with the pencil base 30 by the bolt 30A. A sliding rail 42 is installed on the center of the driving pedestal 40 for the active gear rack 43 with proper length to drive the pencil pedestal 20 through the tooth ring 23. The center of the active gear rack 43 is connected with the L shape approaching lamella 431 through the bolt 40A. The long holes 44 are formed on the two ends of the top of the driving pedestal 40 respectively for linking the sensor 45 through the bolt 40A, the sensor 45 is constructed by the approaching switch, light coupler and other elements for sensing the range of the moving trace of the active gear rack 43 in the sliding rail 42 by matching with the L shape approaching lamella 431.

The driving source 50 is installed on the back of the driving pedestal 40, it can be constructed by the driving component such as the air cylinder, the service motor etc., and is driven by the controlling circuit of the automatic marking machinery. A thread is formed on the end of the linking stick 51 for connecting with the linking elements 52, 53 through the bolts 50A, 50B. A U shape connecting structure is formed by connecting the linking element 53 with the active gear rack 43 for moving the active gear rack 43 horizontally along the sliding rail 42 by the driving of the driving source, so the whole structure of this invention is constructed.

Figure 4:
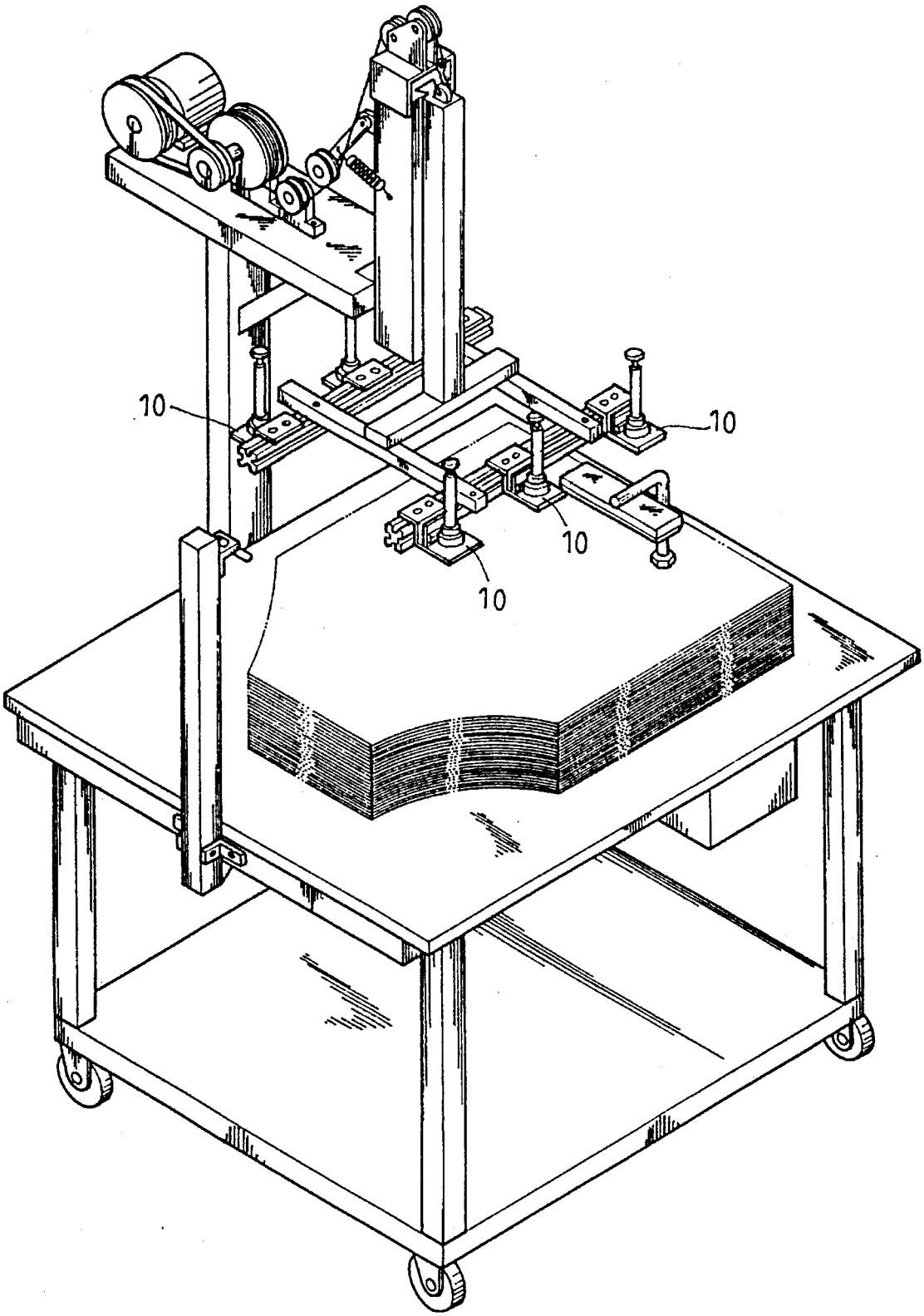
FIG. 4 is the alternative embodiment of the invention.
Figure 5:
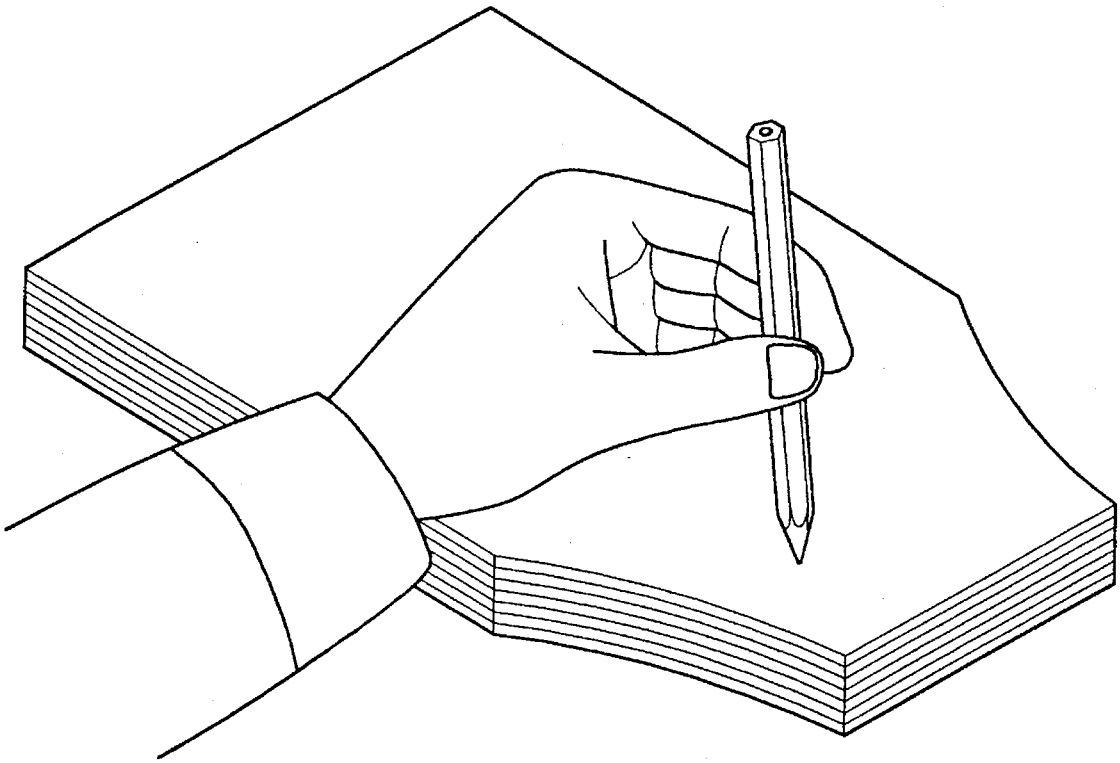
FIG. 5 is a diagram showing the conventional pencil marking method.

As illustrated in FIG. 4, the pencil marking device 100 shown in FIGS. 1, 2, and 3 in practical usage can match with a marking machinery which can move upwards and downwards, wherein, the pencil marking device 100 is mainly connected with the automatic marking machinery at the fixing base 10, and the driving source 50 is driven by the controlling circuit of the automatic marking machinery when the automatic marking machinery moves downwards and touches the clipped cloth, then the active gear rack 43 is driven to move horizontally by the driving source 50. The tooth ring 23 of the pencil pedestal 20 is driven by the horizontal movement of the active gear rack 43 for rotating the pencil pedestal 20 at a fix point, and the pencil B in the pencil pedestal 20 also marks the clipped cloth at a fix point. The moving range of the active gear rack 43 and the number of round trips are sensed by the sensor 45. So feedback is sent to the controlling circuit of the automatic marking machinery. The moving range, trace, number of round trips of the linking stick 51 of the driving source 50 are adjusted and set according to the practical marking state, and then the marking quality and efficiency are increased. So, the disadvantages and the troublesome produced by the conventional manual pencil marking processing are improved.

Having described preferred embodiments of a new and improved design for the marking device in accordance with the present invention, it is believed that other modifications, variations and changes will be suggested to persons skilled in the art in view of the teachings set forth herein. It is therefore to be understood that all such variations, modifications and changes are believed to fall within the scope of the present invention as defined by the appended claims.

We claim:

1. A pencil marking device for clipped cloth, comprising:

a fixing base, an end of which is bent to be an inverse L shape for connecting with an automatic marking machinery which can move upwards and downwards, so that said base being driven to move upwards and downwards by said automatic marking machinery and a marking hole formed on a central portion of said fixing base on the other end;

a pencil pedestal including a sleeve barrel for receiving and cramping the pencil having a predetermined length, tenons installed on two sides of an upper section thereof, a tooth ring circularly formed on a central section of said pedestal, and a circular formed on a lower section of said pedestal;

a pencil base constructed substantially similar to a dimension of said fixing base, said fixing base being screwed on said pencil base, and a receiving groove corresponding to said marking hole and matching with said pencil pedestal formed on a center of said pencil base for stably fixing said pencil pedestal, a needle bearing engaged with a lower section of said pencil pedestal and buckled on the circular groove of said pencil pedestal by a retainer ring;

a top column, a bottom of which formed a receiving end for connecting with a top end of said pencil;

a first elastic brake element and a second elastic brake element for engaging said top column;

a pencil sleeve having a length and an inner diameter matching with said pencil and said top column for stably engaging said pencil sleeve at the upper section of said pencil pedestal by an engagement between an L shaped slot and one of said tenons of said pencil pedestal behind said pencil sleeve, said first elastic brake element and said second elastic brake element being engaged with said top column, wherein said pencil pedestal forming a screw region, and said L shaped slot matching with said tenon of said pencil pedestal on the ends thereof;

a pencil locking component, a lower portion of which formed with a screw part for being screwed in said screw region of said pencil sleeve, and the top end of said pencil being stably fixed by touching the end of said screw part with said top column;

a driving pedestal two sides of a bottom of which is screwed on said fixing base with said pencil base, a sliding rail installed on a center of said driving pedestal for engaging an active gear rack having a predetermined length to drive said pencil pedestal through the tooth ring, a center of said active gear rack connected with an L shape approaching lamella, and two ends of a top of said driving pedestal being connected with sensors respectively for sensing a range of moving trace of said active gear rack in the sliding rail by matching with said L shape approaching lamella;

a driving source installed on the back of said driving pedestal, which being driven by a controlling circuit of said automatic marking machinery, an end of a linking stick being connected with a plurality of linking elements and an U shape connecting structure formed by connecting said linking elements with said active gear rack for moving said active gear rack horizontally along said sliding rail by said driving source; wherein:

said active gear rack in said driving pedestal being driven to move horizontally by said driving source when said automatic marking machinery moves downwards and touches the clipped cloth, said tooth ring of said pencil pedestal being driven by the horizontal movement of said active gear rack for rotating said pencil pedestal at a fix point, thereby said pencil in said pencil pedestal marks the clipped cloth at said fix point, the moving range, trace and number of round trips of said active gear rack are sensed by the sensors and a feedback is sent to the controlling circuit of said automatic marking machinery.

2. The device as set forth in claim 1, wherein the sensor in said driving pedestal comprising an approaching switch or light coupler.

3. The device as set forth in claim 1, wherein said driving source comprising an air cylinder or service motor.

* * * * *